US005834379A

United States Patent [19]

Shealy et al.

[11] Patent Number: 5,834,379

[45] Date of Patent: Nov. 10, 1998

[54] PROCESS FOR SYNTHESIS OF CUBIC GAN ON GAAS USING $NH_3$ IN AN RF PLASMA PROCESS

[75] Inventors: James R. Shealy; James R. Engstrom; Yu-Hwa Lo, all of Ithaca, N.Y.

[73] Assignee: Cornell Research Foundation, Inc., Ithaca, N.Y.

[21] Appl. No.: 680,874

[22] Filed: Jul. 16, 1996

[51] Int. Cl.[6] ..... C23C 11/08

[52] U.S. Cl. ..... 438/767; 438/718; 438/796; 438/798

[58] Field of Search ..... 438/718, 767, 438/796, 798

[56] References Cited

U.S. PATENT DOCUMENTS

| | | | |
|---|---|---|---|
| 4,448,633 | 5/1984 | Shuskus | 438/767 |
| 4,756,792 | 7/1988 | Fujita et al. . | |
| 4,801,557 | 1/1989 | Wessels et al. . | |
| 4,808,551 | 2/1989 | Mori et al. . | |
| 4,885,055 | 12/1989 | Woodbury et al. . | |
| 4,985,742 | 1/1991 | Pankove | 257/197 |
| 5,129,983 | 7/1992 | Greiff . | |
| 5,266,518 | 11/1993 | Binsma et al. . | |
| 5,294,808 | 3/1994 | Lo | 257/17 |
| 5,336,361 | 8/1994 | Tamura et al. | 438/767 |
| 5,468,688 | 11/1995 | Kohl et al. | 438/762 |

OTHER PUBLICATIONS

N. Kuwano et al., "Transmission Electron Microscope Observation of Cubic GaN Grown by Metalorganic Vapor Phase Epitaxy with Dimethylhydrazine on (001) GaAs," Jpn. Appl. Phys. vol. 33, pp. 18–24, Jan. 1994.

Davis, R. F., "Thin films and devices of diamond, silicon carbide and gallium nitride", Physica B 185, 1 (1993) pp. 1–15 No month.

Khan, M.A. et al., "Temperature activated conductance in GaN/AlGaN hetero–structure field effect transistors operting at temperatures up to 300° C." Appl. Phys, Lett. 66, 1083 (1995), pp. 1083–1085 No month.

Nakamura, Shuji et al., "P–GaN/N–InGaN/N–GaN Double Heterostructure Blue–Light–Emitting Diodes", Jpn. J. Appl. Phys. 32, L8 (1993), pp. L8–L11.

Fujieda, Shinji et al., "Structue Control of GaN Films Grown on (001) GaAs Substrates by GaAs Surface Pretreatments", Jpn. J. Appl. Phys. 30, L1665 (1991), pp. L1665–L1667 No month.

Yoshida, S. et al., "Hetero–epitaxial growth of cubic GaN on GaAs by gas–source molecular beam epitaxy", Surf. Sci. 267, 50 (1994), pp. 50–53 No month.

Kikuchi, Akihiko et al., "Substrate Nitridation Effects on GaN Grown on GaAs Substrates by molecular Beam Epitaxy Using RF–Radical Nitrogen Source", Jpn. J. Appl. Phys. 33, 688 (1994), pp. 688–693 No month.

Bharatan, S. et al., "Structural characterization of GaN and $GaAs_xN_{1-x}$ grown by electron cyclotron resonance–metalorganic molecular beam epitaxy", J. Vac. Sci. Technol. A12 1094 (1994), pp. 1094–1098 No month.

(List continued on next page.)

*Primary Examiner*—Charles L. Bowers, Jr.
*Assistant Examiner*—Keith Christianson
*Attorney, Agent, or Firm*—Jones, Tullar & Cooper

[57] ABSTRACT

A process for synthesizing wide band gap materials, specifically, GaN, employs plasma-assisted and thermal nitridation with $NH_3$ to convert GaAs to GaN. Thermal assisted nitridation with $NH_3$ can be employed for forming layers of substantial thickness (on the order of 1 micron) of cubic and hexagonal GaN on a GaAs substrate. Plasma-assisted nitridation of $NH_3$ results in formation of predominantly cubic GaN, a form particularly useful in optoelectronic devices. Preferably, very thin GaAs membranes are employed to permit formation thereon of GaN layers of any desired thickness without concern for critical thickness constraints. The thin membranes are preferably formed either with an epitaxial bonding technique, or by undercut etching.

6 Claims, 6 Drawing Sheets

OTHER PUBLICATIONS

He, Z. Q. et al., "Molecular–Beam–epitaxy growth of GaN on GaAs(100) by using reactive nitrogen source", Appl. Phys. Lett. 64, 314 (1994), pp. 315–317.

Lei, T. et al., "Heteroepitaxy, polymorphism, and faulting in GaN thin films, on silicon and sapphire substrates", J. Appl. Phys. 74, 4430 (1993) pp. 4430–4437.

Vogt, Kirkland W. et al., "Gallium arsenide passivation through nitridation with hydrazine", J. Appl. Phys. 74, 6448 (1993), pp. 6448–6450 No month.

Kuwano, Noriyuki et al., "Transmission Electron Microscope Observation of Cubic GaN Grown by Metalorganic Vapor Phase Epitaxy with Dimethylhydrazine on (001) GaAs", Jpn. J. Appl. Phys. 33, 18 (1994), pp. 18–22 No month.

Deal, B.E. et al., "General Relationship for the Thermal Oxidation of Silicon", J. Appl. Phys. 36, 3770 (1965) No month.

Hiramatsu, K. et al., "Browth mechanism of GaN grown on sapphire with AIN buffer layer by MOVPE", J. Cryst. Growth 115, 628 (1991), pp. 628–633 No month.

PROCESS FOR SYNTHESIS OF CUBIC GAN ON GAAS USING $NH_3$ IN AN RF PLASMA PROCESS

BACKGROUND OF THE INVENTION

The present invention relates in general to a process for synthesizing wide band gap semiconductor materials using thermal. and plasma-assisted nitridation of GaAs.

Wide band gap semiconductors, specifically GaN, are of great interest in the manufacture of optoelectronic devices such as UV-visible light-emitting diodes and high power RF sources. While most devices have been based upon hexagonal (wurtzite) films of GaN, cubic (zinc-blende) GaN films are also of significant interest. Cubic GaN has been grown by both thermal and plasma-or ion-assisted techniques. For thermal growth, nitridation, performed by exposure of the substrate to the reactive nitrogen species (e.g., hydrazine, $N_2H_4$, and dimethylhydrazine, $N_2H_2(CH_3)_2$), has been shown to be a key step in the nucleation of cubic GaN films on GaAs(100). "Insufficient" thermal nitridation has been reported to result in the deposition of hexagonal films. Concerning rf (13.56 MHz) plasma-assisted deposition of cubic GaN employing $N_2$, nitridation is deleterious, and in fact results in the growth of hexagonal films instead. In contrast, exposure of GaAs(100) to an ECR microwave $N_2$ plasma source or a cold cathode ion gun with $N_2$ produces cubic GaN films upon subsequent deposition. Study of the kinetics of nitridation, on the other hand, has been virtually nonexistent, often only the final film thickness has been reported. Nitridation employing hydrazine at 300°–400° C. produces films limited to ~100 Å in thickness, whereas for GaAs nitrided with dimethylhydrazine at 650° C., films were found to be an order of magnitude thicker.

SUMMARY OF THE INVENTION

The present invention provides a new nitridation process far forming wide band gap semiconductors, such as GaN. More particularly, the present invention is directed to a nitridation process in which $NH_3$ is used to form substantial layer thicknesses that can be applied to devices. A plasma-assisted nitridation of GaAs(100) is also used to form GaN. Surprisingly, experimental results have established that with this specific plasma-assisted nitridation process, the resulting GaN has a predominantly cubic structured surface in contrast to the hexagonal or mixed hexagonal and cubic structured surfaces normally obtained from other nitridation processes. The process is very valuable since cubic oriented GaN makes possible laser facet cleavage, and has many other advantageous electronic properties. It is thus a preferred orientation to the hexagonal structure for optoelectronic applications.

In a first preferred embodiment, a plasma-assisted nitridation process is employed for converting a GaAs(100) substrate to GaN. This is accomplished by placing GaAs (100) substrates in a low pressure reactor with RF pulse plasma capability, and then exposing the substrates to $NH_3$ reactant gas. and an RF plasma for an extended period of time. The exposure of the surface of the GaAs substrate to the $NH_3$ reactant gas results in conversion of a thin layer of the GaAs to GaN. In contrast to other known nitridation processes, the $NH_3$, RF plasma-assisted nitridation results in cubic crystal GaN with thicknesses approaching 1000 Å, and with very high quality surfaces.

In a second preferred embodiment of the present invention, a thermal nitridation process is also employed for converting a GaAs(100) substrate to GaN. Previously, such a thermal nitridation process was thought only to be capable of growing a one or two monolayer thickness of GaN because it was thought that the nitrogen could not diffuse through the resulting film to the GaAs substrate. However, it has now been discovered that film thicknesses approaching one micron can be obtained using thermal. nitridation of GaAs(100) for up to 2 hours at temperatures of approximately 600° C. or more. Experiments have shown that the resulting GaAs films are composed of both polycrystalline cubic and hexagonal GaN.

Another significant feature of the present invention is a technique employed to compensate for the large thermal mismatch between the GaAs substrate and the GaN film that is formed thereon. As the thickness of the film increases, the thermal mismatch causes it to crack or peel off of the GaAs substrate. Since a thick fully nitrided film is much preferred to provide a high quality template for subsequent nitride growth, a solution to the thermal mismatch problem is necessary.

The present invention solves the mismatch problem by employing the technique disclosed in U.S. Pat. No. 5,294,808 to Yu-Hwa Lo. In this technique, the substrate comprises a very thin membrane which is suspended by a thicker, conventional substrate. The thickness of the membrane is selected to be below the critical thickness above which dislocations form so that a heteroepitaxial structure of any thickness can be formed on the membrane without any dislocations or thermal mismatches. This technique can be employed with the plasma-assisted and thermal nitridation processes of the present invention by forming the GaAs (100) substrate out of a thin membrane that is suspended by a conventional GaAs substrate. The GaAs(100) membrane is then exposed to the plasma-assisted or thermal nitridation process, thereby forming a layer of GaN of any desired thickness on the membrane.

Two different fabrication techniques are employed to form the thin GaAs(100) membranes. The first employs epitaxial bonding wherein two GaAs substrates are bonded to one another. The first substrate has a pattern formed thereon which defines the shape of the membrane, while the second substrate has a thin GaAs epilayer formed thereon that actually forms the membrane after bonding and etching to remove the second substrate. The second technique employs undercut etching of a sacrificial layer beneath a thin GaAs epilayer. To prevent the GaAs epilayer from collapsing during undercut etch, a stressed thin film is deposited on the epilayer which causes the membrane surface to be convexed after etching. The stressed thin film is then removed to permit the GaAs membrane to reassume its flat configuration.

BRIEF DESCRIPTION OF THE DRAWINGS

The features and advantages of the present invention will become apparent from the following detailed description of a preferred embodiment thereof, taken in conjunction with the accompanying drawings in which.

DETAILED DESCRIPTION OF THE PREFERRED EMBODIMENTS

Figure 1:
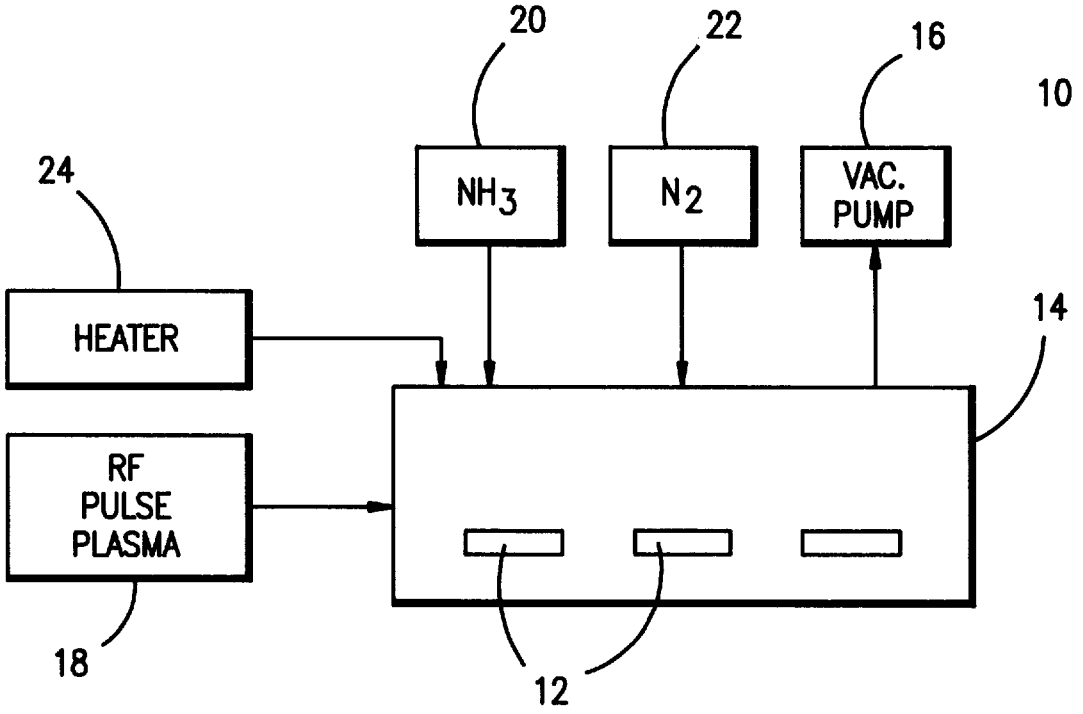
FIG. 1 is a schematic diagram of a system for plasma-assisted nitridation of GaAs substrates.

FIG. 1 illustrates a system 10 for thermal or plasma-assisted nitridation of a plurality of GaAs(100) substrates 12 in accordance with the preferred embodiments of the present invention. The substrates 12 are disposed in a commercial, horizontal hot wall (quartz) low pressure reactor chamber 14. A vacuum pump 16 is connected to the reactor chamber 14 for maintaining subatmospheric pressure therein during treatment of the substrates 12. An RF pulse plasma source (e.g. 450 kHz) 18, a reactant gas source 20 and a carrier gas source 22 are also connected to the reactor 14 for effecting plasma-assisted nitridation of the substrates 12. Preferably, the reactant gas comprises ULSI grade $NH_3$, and the carrier gas is dry $N_2$ which has been evaporated from liquid $N_2$, 99.995%, $O_2$<8 ppm, $H_2O$<5 ppm. The feed ratio of the two gases is preferably on the order of approximately 1:10 $NH_3$:$N_2$. Finally, a heater 24 is provided for heating the wall of the reactor chamber 14.

Experiments were conducted with the system 10 to form cubic GaN from GaAs(100) substrates by employing the thermal and plasma-assisted nitridation processes of the present invention. First, the GaAs(100) substrates 12 were degreased in acetone and methanol, etched with 5:1:1 $H_2So_4$:$H_2O_2H_2O$ and dipped in buffered HF immediately prior to being loaded into the reactor chamber 14. The temperature range examined was 590°–680° C., while the total pressure in the reactor chamber was held constant at 1 Torr.

Figure 2:
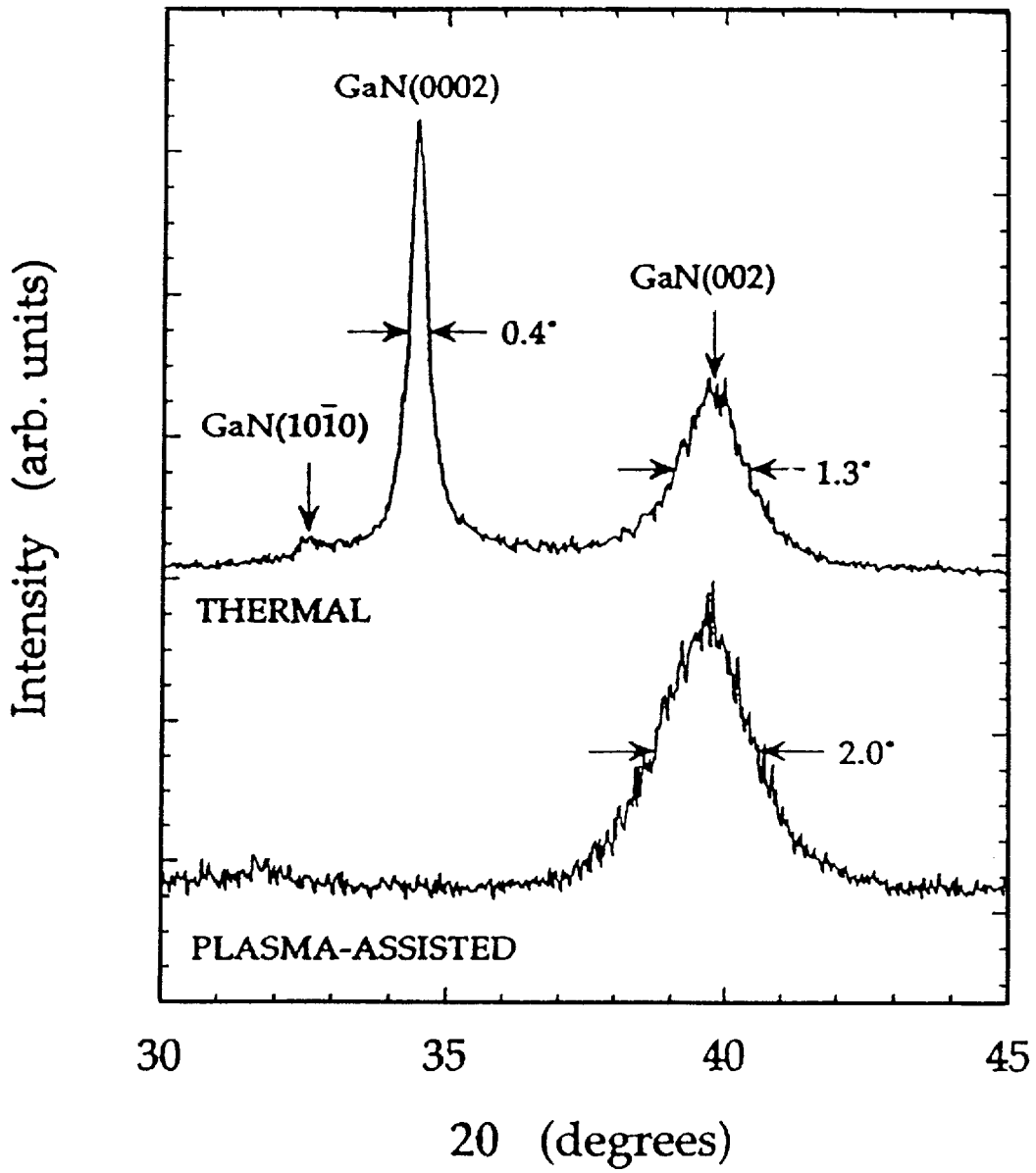
FIG. 2 is a graph illustrating an X-ray diffraction scan of thermally and plasma nitrided GaAs(100) at a nitridation temperature of 680° C.

FIG. 2 illustrates the representative X-ray diffraction scans for two GaAs substrates or surfaces which have been nitrided with the system 10 at 680° C. for 60 minutes. The top scan corresponds to the thermal nitridation process embodiment of the present invention where the pulse plasma source 18 is not activated, while the bottom scan illustrates the results of the plasma-assisted process embodiment of the present invention. In both cases, the resulting films were found to be polycrystalline (insensitive to azimuthal rotation). For thermal nitridation, three peaks are evident at 32.5°, 34.5°, and 39.8°, which correspond to the hexagonal GaN($10\bar{1}0$), (0002), and cubic GaN(0002) reflections. An additional hexagonal GaN peak (GaN($11\bar{2}0$)) was observed at 57.7°, but is not illustrated in FIG. 2. It should be noted that for all of the diffraction scans, the substrate was slightly tilted (<2°) from the Bragg plane to prevent obscuring hexagonal GaN peaks with the GaAs(002) reflection. Clearly, both cubic and hexagonal regions are present in the thermally nitrided films. On the other hand, plasma excitation of the $N_2$ and $NH_3$ mixture in accordance with the present invention produces a dramatic change in film structures as may be seen in the lower scan plotted in FIG. 2. In particular, only the cubic GaN (002) peak at 39.7° remains, and the hexagonal GaN peaks disappear entirely. Extended (thermal) exposure of these cubic films to the reacting gas did not lead to any detectable formation of hexagonal GaN regions. The sole existence of the cubic polytype for all plasma-exposed substrates indicates a significant unexpected change in the nitridation process.

Figure 3:
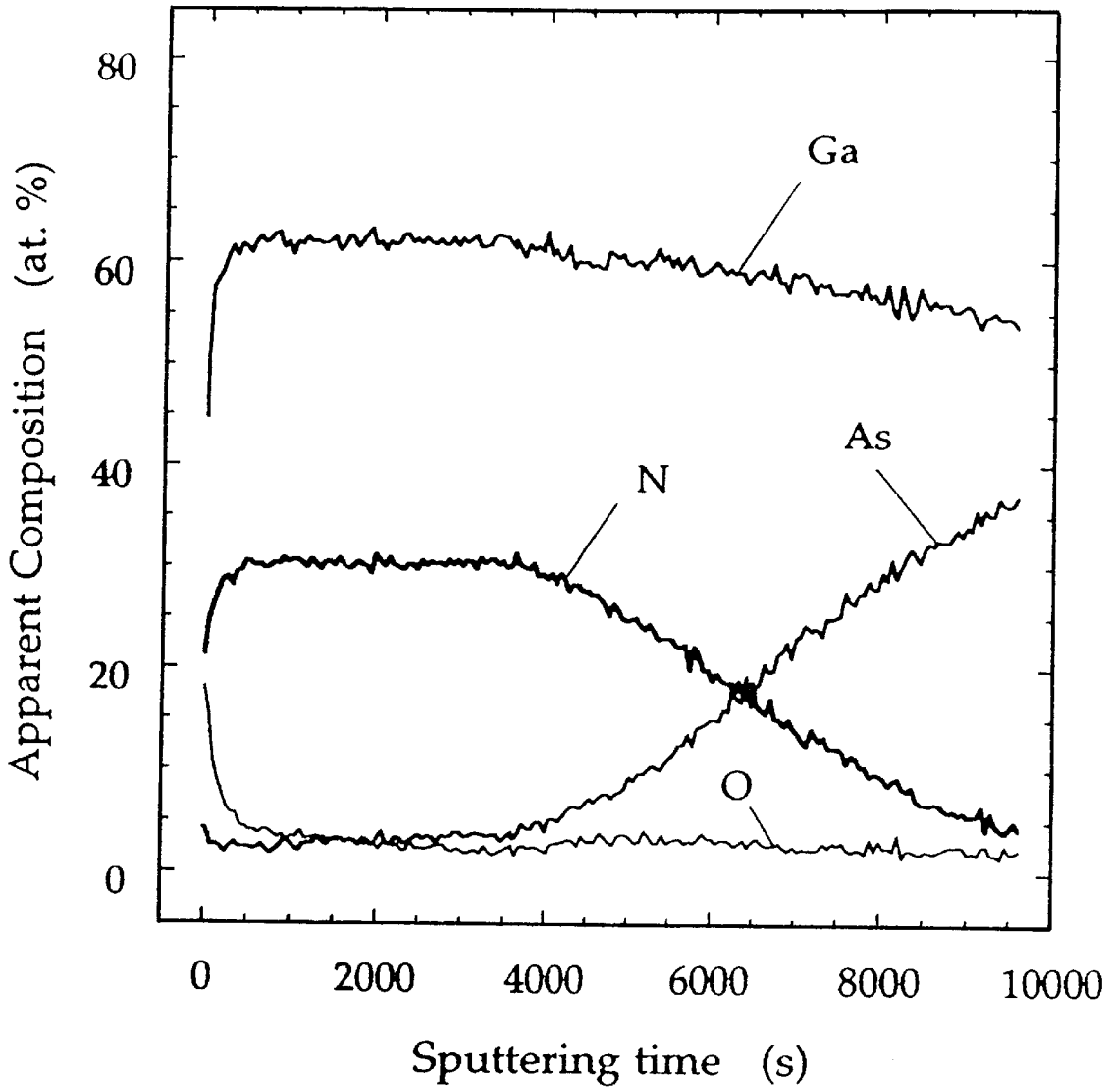
FIG. 3 is a graph illustrating the Auger electron spectroscopic depth profile of a thermally nitrided GaAs(100) surface with a 120 minute exposure at 650° C. showing composition as a function of sputtering time in seconds.

An Auger electron spectroscopic (AES) depth profile of another film is illustrated in FIG. 3. This film was thermally nitrided at 650° C. for 120 minutes, and the spectra are typical of films nitrided in this manner. As may be seen, a film composed essentially entirely of Ga and N is clearly present on the surface, followed by a transition region where the nitrogen content decreases concurrently with increasing arsenic content. The atomic compositions in FIG. 3 were calculated employing atomic sensitivity factors, and the measured Auger transition peak-to-peak heights. As these have not been calibrated against. a GaN standard, these are apparent compositions. On the other hand, the effective differential sputtering of Ga, As and N can easily explain the apparently nonstoichiometric compositions for GaN and GaAs. For example, a controlled GaAs sample exhibited the same apparent composition as that observed at long times (10,000 seconds) for the sample considered in FIG. 3.

The assignment of the $GaAs_xN_{1-x}$ transition region to true film composition changes, as opposed to ion beam mixing, may be justified as follows. Specifically, the width of the transition regime for the C and O signals at the vacuum/surface interface can be employed to estimate the range of ion induced mixing. In particular, the width of this transient, characteristic of ion mixing effects, is far smaller than that of the $GaAs_xN_{1-x}$ transition region. Therefore, based on this argument, the observed concentration gradation is real. Finally, it should be noted that while oxygen content is low (<1.5%), it is present throughout the nitrided film.

The existence of a mixed $GaAs_xN_{1-x}$ transition layer is supported by measurements involving both Raman scattering and low temperature (1.6K) photoluminescence. For example, in addition to the bulk GaN optical phonon, the Raman spectra contained a well defined "GaAs-like" vibrational mode at 288 $cm^{-1}$, downshifted 4 $cm^{-1}$ from the GaAs bulk. The photoluminescence spectra indicated visible emission, spanning the range from blue to the infrared, suggesting as much as 50% N in the $GaAs_xN_{1-x}$ transition layer, assuming the band gap of this material varies linearly with N content.

The dependence of the nitride layer thickness (measured via. ellipsometry and spectrophotometry) on reaction time and temperature has been examined for the thermal nitridation process. Reaction time in this case was defined by the exposure time at the "target" temperature, not including the time required for the heating cycle (1 hour) or the cooling cycle (4–6 hours). Reaction times ranged from 30 to 240 minutes and three temperatures were examined; 620°, 650° and 680° C. As may be seen in FIG. 4, the GaN film thickness increased with increasing temperature, but the film growth rate decreased at longer nitridation times, almost certainly due to a diffusion rate limitation, probably involving counter diffusion of As and N. At temperatures lower than 620° C., the film thicknesses were difficult to measure accurately but were estimated to be less than 100 Å. Similar values have been reported for low temperature (300°–400° C.) niridation with $N_2H_4$. For plasma-nitrided GaAs surfaces, the film thicknesses observed were all less than 1000 Å for exposures of up to 2 hours at temperatures up to 680° C. It is unclear whether this significant reduction in film thickness was due to simultaneous growth and etching by the plasma, or to a change in the diffusion coefficient of either N, As or possibly Ga through the cubic GaN film. It should be noted that due to the presence of both a constant composition GaN layer and $GaAs_xN_{1-x}$ transitional layer, these film thicknesses determined via optical methods are convoluted by the presence of both layers.

Figure 4:
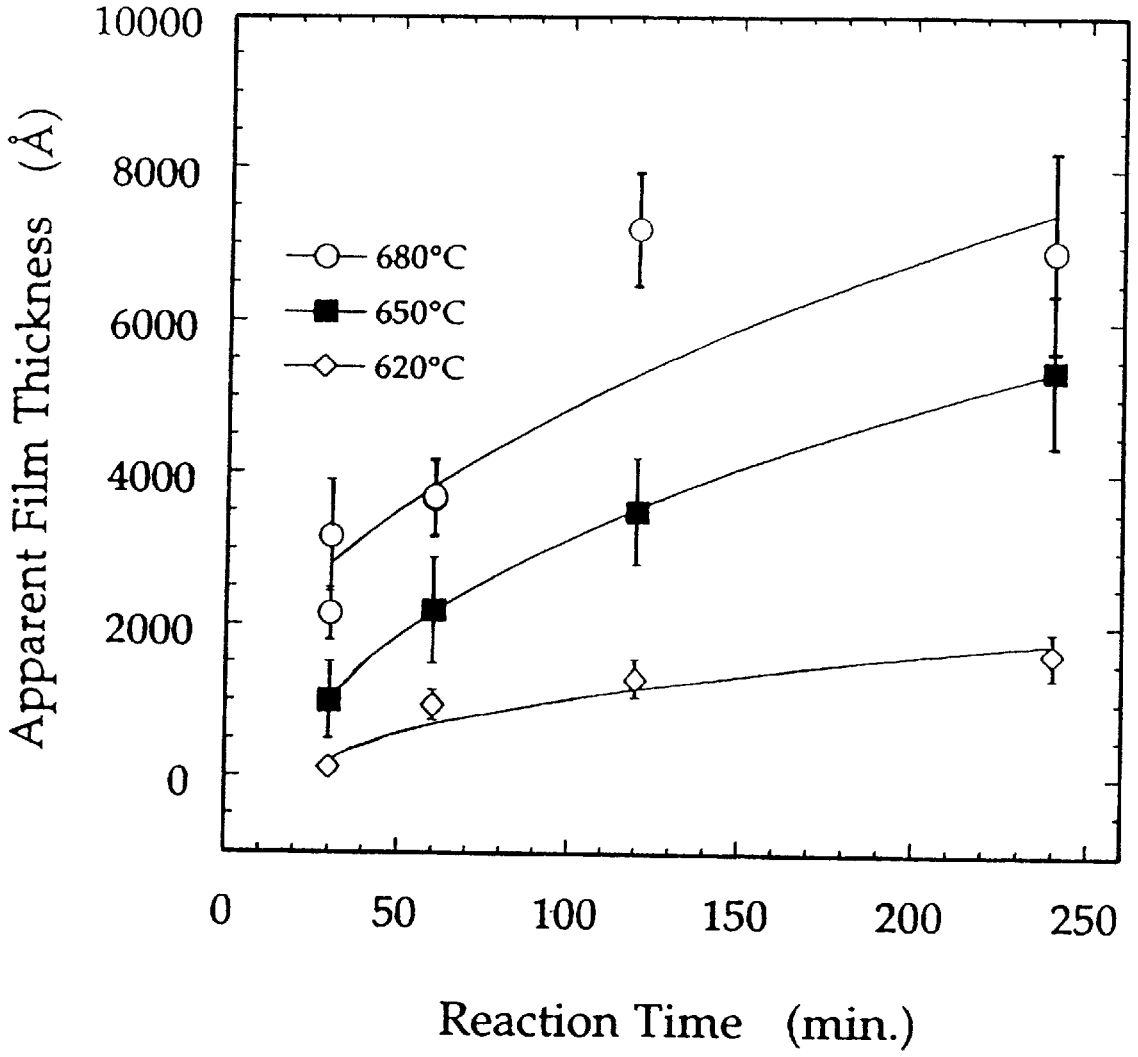
FIG. 4 is a graph illustrating GaN film thickness as a function of thermal nitridation time for three temperatures: 620°, 650° and 680° C.

The Deal and Grove model of silicon oxidation was employed to evaluate the kinetics of the thermal nitridation process. The smooth curves illustrated in FIG. 4 represent a fit of the data to the Deal and Grove model for coupled diffusion/interface reaction. It is assumed that single component diffusion through the nitrided layer and a first-order reaction at the GaN/GaAs interface is sufficient to describe the kinetics. Thus, diffusion and/or reaction of the other components is ignored in this simplified analysis. As may be seen in FIG. 4, this model provides a respectable fit to the data, but due to the limited number of temperatures examined, it was not possible to extract reliable values for the kinetic parameters.

Surface morphology was examined employing an atomic force microscope. For the thermally nitrided substrates, the surface was observed to be granular, with a typical rms roughness value of 220 Å (a controlled GaAs sample gave an rms of 6.4 Å). Clearly, significant roughening of the surface has occurred. Plasma-exposed surfaces exhibited greatly reduced surface roughness, however, with a typical rms of 13 Å. As such, the plasma-nitrided films may provide better templates for subsequent GaN deposition.

While observation of both hexagonal and cubic GaN in the thermally nitrided films may appear unusual, especially given the previously conducted thermal GaN growth studies where a nitridation step was thought to be crucial to eliminating hexagonal GaN deposition, evidence exists to support the presence of both polytypes in these cubic films. The coexistence of the two polytypes in predominantly cubic films has been reported for GaN growth on Si(100), thermally nitrided GaAs and ECR plasma nitrided GaAs. Selected area diffraction patterns from transmission electron micrograph samples of cubic GaN/GaAs demonstrate the presence of both cubic and hexagonal regions of GaN near the interface, even when x-ray diffraction indicated only cubic GaN. It has been postulated that the hexagonal GaN originated from the GaN buffer layer near the GaN/Si interface, which decreased in abundance during GaN deposition due to differing crystallographic growth rates that favor cubic GaN growth. As the growth of hexagonal GaN was reported to proceed in a columnar fashion, with one crystallographic orientation eventually dominating, it is possible that a similar mechanism exists in the growth of cubic GaN on nitrided GaAs(100). Therefore, a template with a minimized number of hexagonal "seed" regions may be critical in eliminating hexagonal regions and producing a predominantly cubic structure in the deposited film.

In summary, Applicants have discovered that thermal nitridation of GaAs(100) using $NH_3$ results in films of substantial thickness (upwards of 1 micron) composed of both polycrystalline cubic and hexagonal GaN. In stark contrast, plasma-assisted nitridation results in polycrystalline GaN films that are, within the limits of detection, purely cubic, and nearly stoichiometric with a thin $GaAs_xN_{1-x}$ graded transition layer being formed between the GaAs(100) substrate and the GaN film. Thus, plasma-assisted nitridation of GaAs is very useful for the formation of templates for homoepitaxial growth of cubic GaN.

Both plasma-assisted and thermal nitridation of GaAs can thus be very useful for forming thick GaN films in the manufacture of optoelectronic devices. However, the bottleneck problem for these otherwise very promising surface nitridation processes, is the large thermal mismatch between GaAs and GaN. In particular, it was found that the nitrided films formed using these processes could crack or peel off of the GaAs substrate when the film thickness exceeds several hundred nanometers. However, a thicker fully nitrided film is much preferred to provide a high quality template for subsequent nitride growth. To solve this problem, a fabrication process is employed wherein the GaAs substrate is made of a very thin membrane so that the GaN film can be grown to any desired thickness without the formation of misfit dislocations or other defects which could cause cracking or peeling. This basic approach is disclosed in U.S. Pat. No. 5,294,808 to Yu-Hwa Lo, and this patent is hereby incorporated by reference.

Figure 5A:
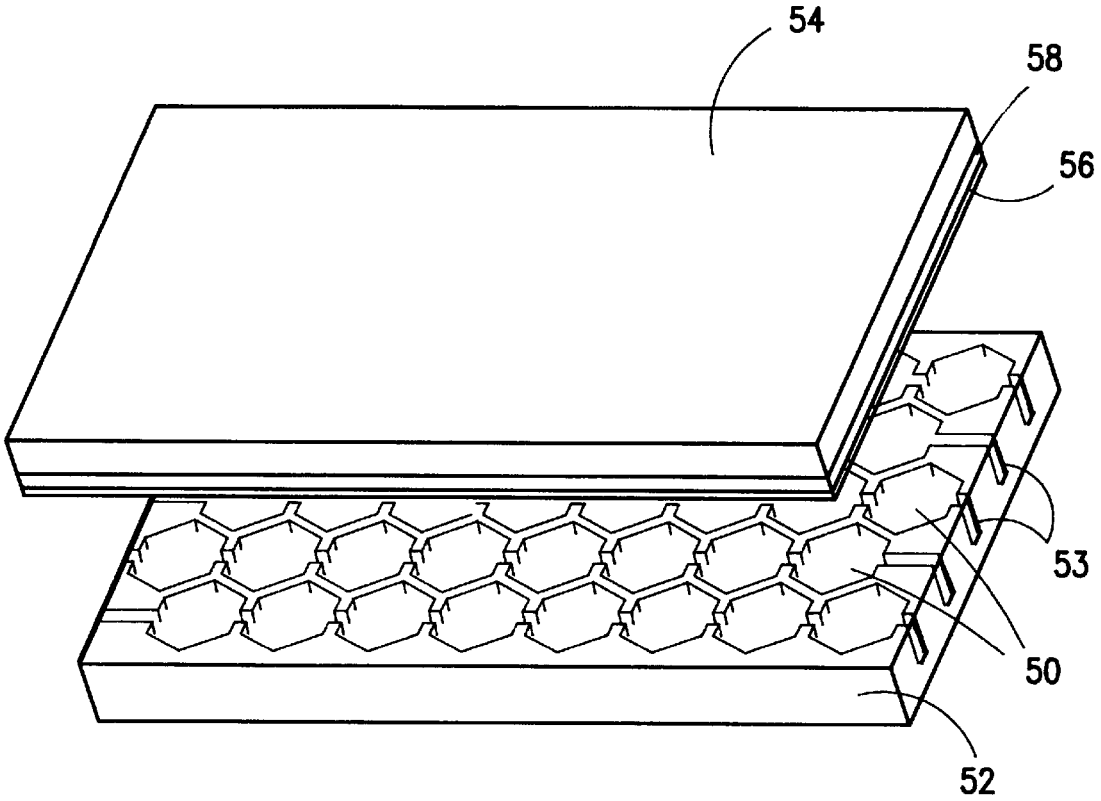
FIGS. 5A and 5B are schematic illustrations of a process for forming GaAs membranes using an epitaxial bonding technique; and, FIGS. 6A–6C are schematic illustrations of a process for forming GaAs membranes using an undercut etching technique.
Figure 5B:
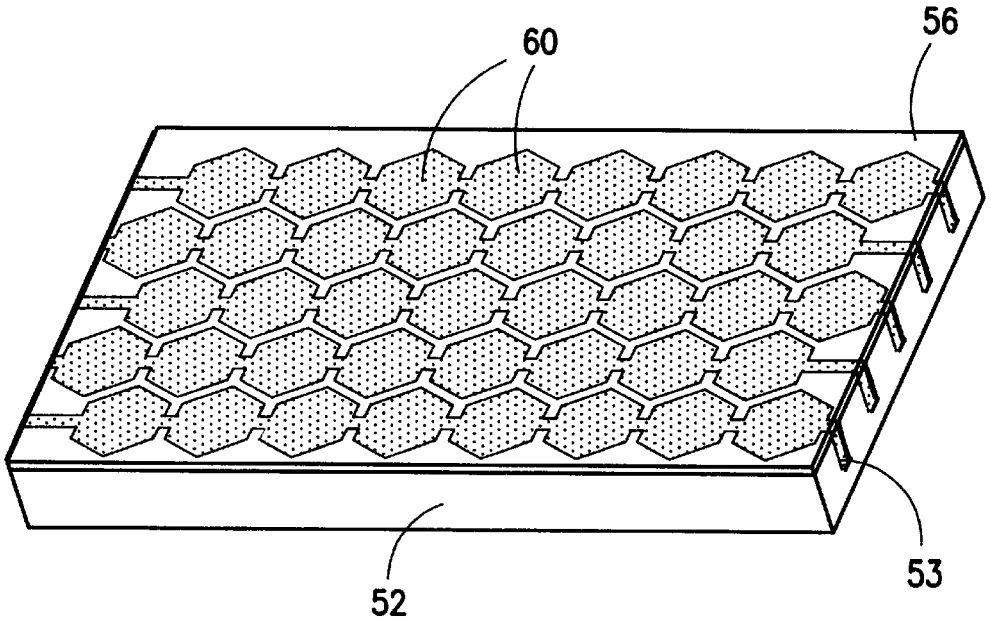

The thin GaAs membranes can be fabricated using, for example, either of two technologies, epitaxial bonding and undercut etching, both of which can produce high integrity thin membranes with high fill factor (50% or greater) and scalability (they can both be applied to 3 inch GaAs wafers). FIGS. 5A and 5B outline the epitaxial bonding process for membrane fabrication. A honeycomb structure comprising a plurality of hexagonal cavities 50 is first formed on a first GaAs wafer substrate 52 by dry etching. At the same time, a plurality of pressure release channels 53 is etched in the substrate 52 to provide outlets for high pressure gas that is generated during the subsequent high temperature bonding process. A second GaAs wafer substrate 54 is formed with a thin (approximately 50 nm) GaAs top epilayer 56 that will form the thin membranes and a relatively thick (approximately 1 micron) AlAs etch stop layer 58. The second substrate 54 is then bonded to the honeycomb patterned GaAs wafer substrate 52 at approximately 600° C. under pressure in a hydrogen environment. After wafer bonding, the second substrate 54 is jet etched, thereby leaving the AlAs etch stop layer 58 and epitaxial GaAs layer 56 on the patterned GaAs wafer substrate 52. Just before the nitridation process is carried out, the AlAs etch stop layer 58 is removed with BHF and the fresh 50 nm GaAs thin membrane comprised of the epilayer 56 is exposed as illustrated in FIG. 5B. This results in the formation of a plurality of hexagonal shaped membranes 60 which are each suspended above a corresponding one of the hexagonal shaped cavities 50.

Figure 6A:
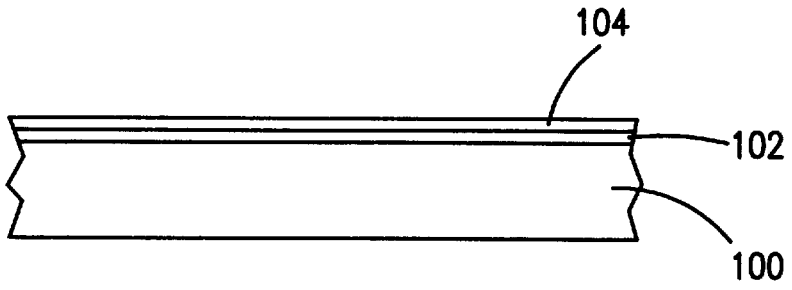
Figure 6B:
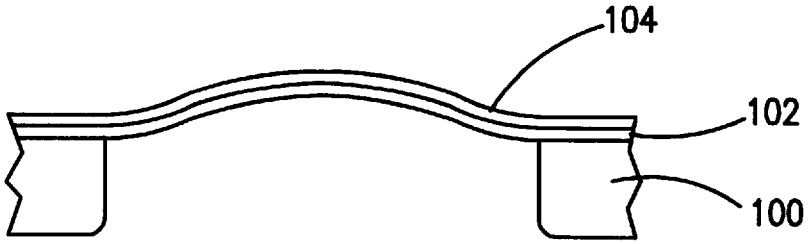
Figure 6C:
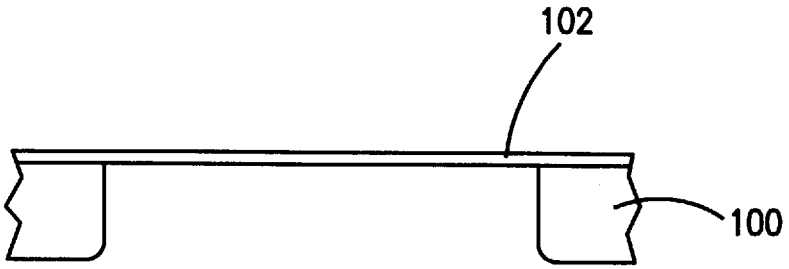

The undercut etch method for suspended membrane fabrication is illustrated in FIGS. 6A–6C in which an AlAs sacrificial layer 100 is etched from under a GaAs thin epilayer 102. A stressed thin film 104 is first deposited on the GaAs epilayer 102 as illustrated in FIG. 6A. When a portion of the AlAs sacrificial layer 100 is removed by undercut etch, the stress in the deposited thin film 104 creates a convex membrane surface as illustrated in FIG. 6B. The bending force is designed to be sufficiently large to overcome the surface tension of the liquid that tends to stick the GaAs thin epilayer 102 to the substrate surface, thereby causing membrane collapse. Finally, the top stressed thin film 104 is removed by dry etching and a flat suspended GaAs membrane 102 is formed as illustrated in FIG. 6C.

Although the invention has been disclosed in terms of a number of preferred embodiments and variations thereon, it will be understood that numerous additional variations and modifications could be made thereto without departing from the scope of the invention as defined in the following claims.

What is claimed is:

1. A process for forming a cubic crystal GaN layer on a GaAs substrate layer comprising the steps of:

a) providing a GaAs substrate;

b) placing said substrate in a reactor chamber;

c) heating said reactor chamber to a temperature of at least approximately 590° C.; and d) supplying $NH_3$ reactant gas and an RF plasma to said reactor chamber for nitriding said substrate to form a layer of cubic crystal GaN on said substrate.

2. The process of claim 1, wherein said step of providing a GaAs substrate further comprises forming a thin GaAs membrane to be exposed to said nitridation to form a layer of GaN on said thin GaAs membrane.

3. The process of claim 2, wherein said step of forming a thin GaAs membrane further comprises:

i) providing a first GaAs substrate having a plurality of cavities formed thereon;

ii) providing a second GaAs substrate having a thin GaAs epilayer formed thereon;

iii) bonding said first and second GaAs substrates to one another using epitaxial bonding; and iv) removing said second GaAs substrate, thereby leaving said thin GaAs epilayer disposed on said first GaAs substrate over said plurality of cavities.

4. The process of claim 2, wherein said step of forming said thin GaAs membrane further comprises:

i) forming a thin GaAs epilayer on a sacrificial layer;

ii) forming a stress imparting layer on top of said GaAs epilayer;

iii) undercut etching said sacrificial layer to remove said sacrificial layer from under said GaAs epilayer; and, iv) removing said stress imparting layer from said GaAs epilayer.

5. The process of claim 1, wherein said step of supplying further comprises supplying $NH_3$ reactant gas and an RF plasma to said reactor chamber for between 30 and 240 minutes.

6. The process of claim 5, wherein said step of heating said reactor chamber further comprises heating said reactor chamber to approximately 650°–680° C.

* * * * *